US005669864A

United States Patent [19]

Brister

[11] Patent Number: 5,669,864

[45] Date of Patent: Sep. 23, 1997

[54] ROLLING EXERCISE BENCH

[76] Inventor: Timothy G. Brister, 631 75th St., Tuscaloosa, Ala. 35405

[21] Appl. No.: 648,955

[22] Filed: May 16, 1996

Related U.S. Application Data

[63] Continuation-in-part of Ser. No. 515,016, Aug. 14, 1995, abandoned.

[51] Int. Cl.[6] ..... A63B 26/00

[52] U.S. Cl. ..... 482/132; 482/142

[58] Field of Search ..... 482/132, 146, 482/142; 280/11.115, 87.042

[56] References Cited

U.S. PATENT DOCUMENTS

| | | | |
|---|---|---|---|
| 5,016,726 | 5/1991 | Metcalf | 280/87.042 |
| 5,310,202 | 5/1994 | Goodspeed | 280/11.115 |
| 5,381,870 | 1/1995 | Kaufman | 280/87.042 |

*Primary Examiner*—Lynne A. Reichard
*Attorney, Agent, or Firm*—Nies, Kurz, Bergert & Tamburro

[57] ABSTRACT

A lightweight exercise device offers variable resistance, including assisted resistance, for strengthening and conditioning various parts of the body. The device may be strapped to the user's back and is provided with rollers for contact with a wall, door, pad, or floor. The rollers, are mounted on rotatable axles on the rear face of the device and operate in conjunction with a tensioning system which uses durable elastic cords or bands. As the rollers are rotated in one direction, the cords or bands wind about the axles thereby progressively increasing the cord or band tension. This increased tension thereby increases the resistance to rotation of the axles and the rollers mounted thereon. As the rollers are rotated back, the cords or bands unwind and the roller resistance decreases. The cords or bands may be wound by rolling the rollers or, in one embodiment, by turning a tension preadjustment crank connected to an intermediate axle. In one embodiment of the invention, the cords are connected to cams maintained on the axles. The cords or bands are easily connected to the axles so that the range of resistance provided by the device may be changed simply by changing the size and flexibility of one or more cords or bands. The device is of particular use in performing exercises for the legs, shoulders, and abdomen.

27 Claims, 10 Drawing Sheets

FIG. 4
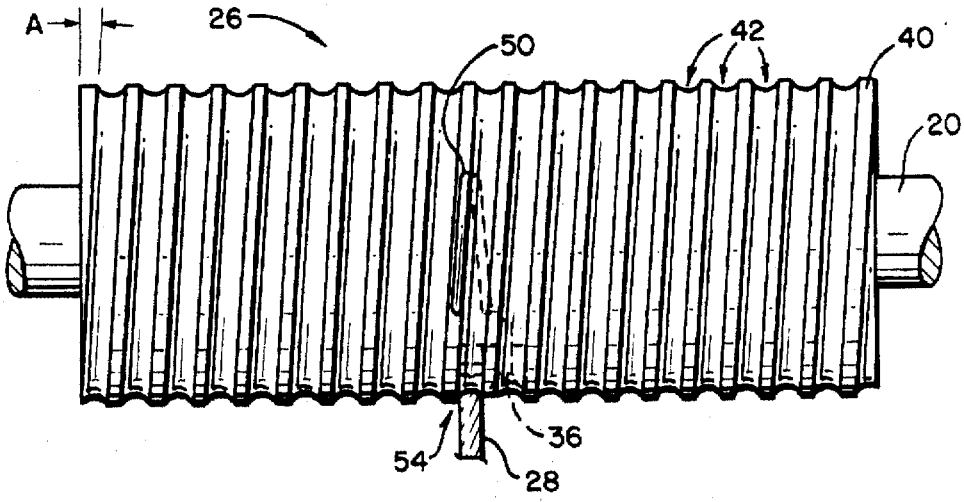
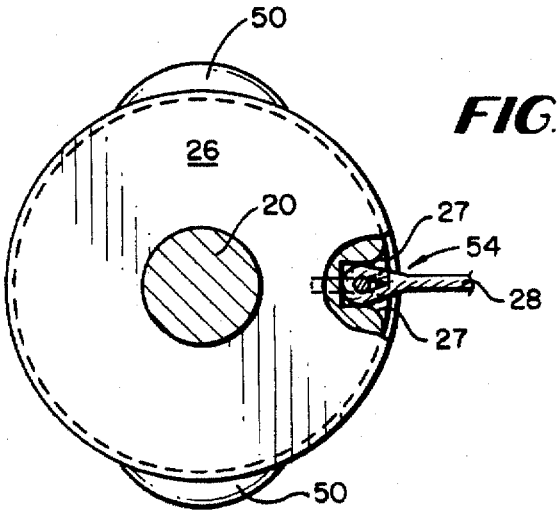
FIG. 5
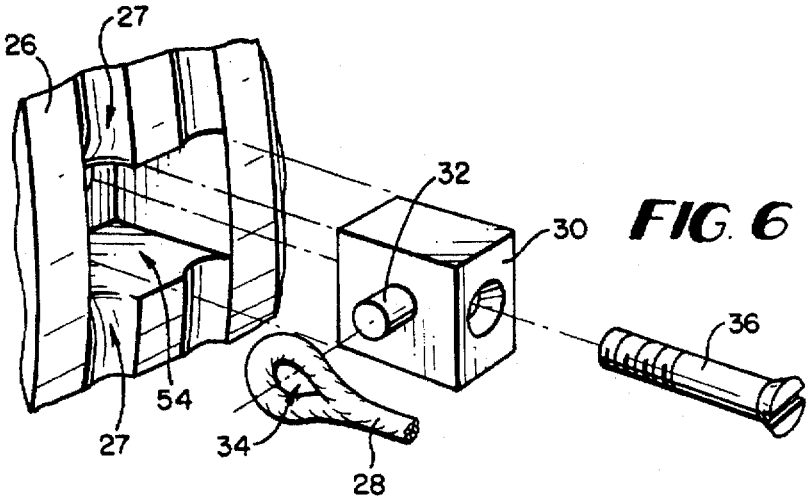
FIG. 6

FIG. 7
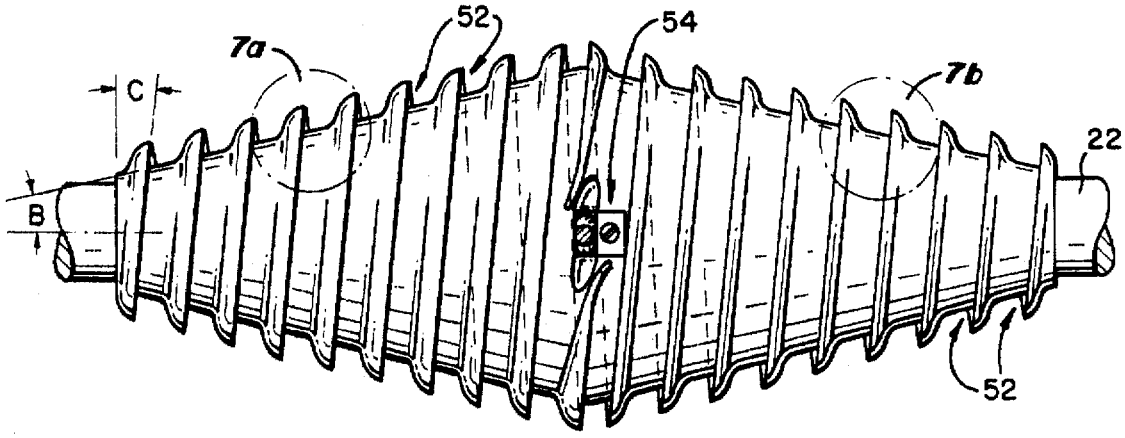
FIG. 7a
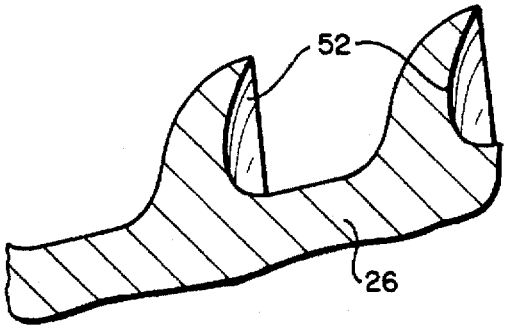
FIG. 7b
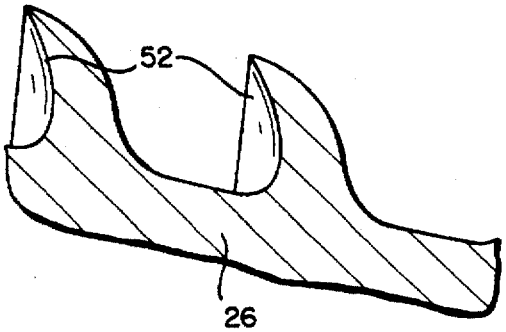
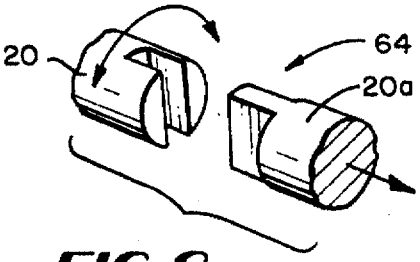
FIG. 8

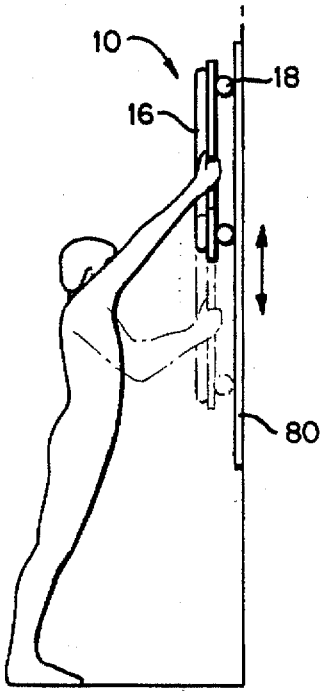
FIG. 9a
FIG. 9b
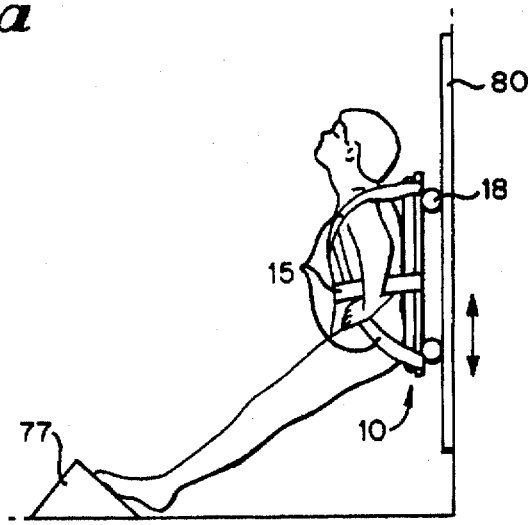
FIG. 9d
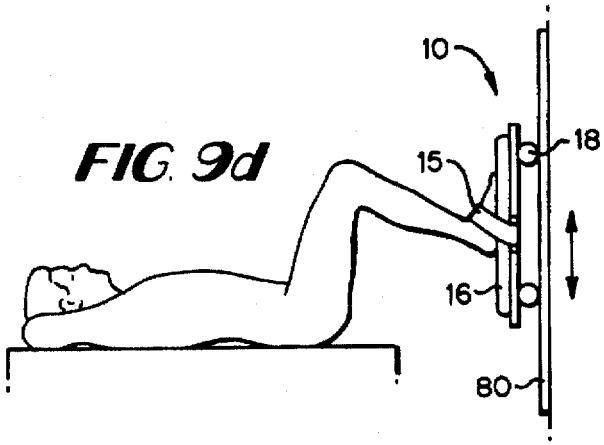
FIG. 9c
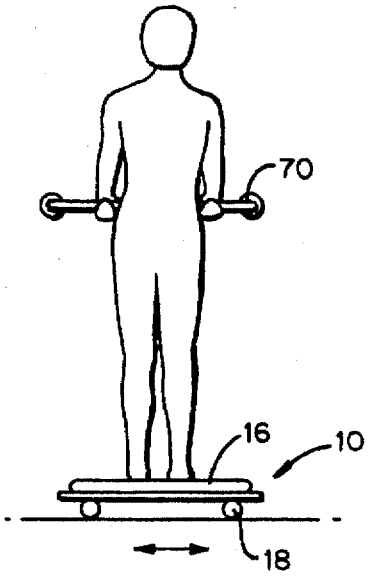
FIG. 9e
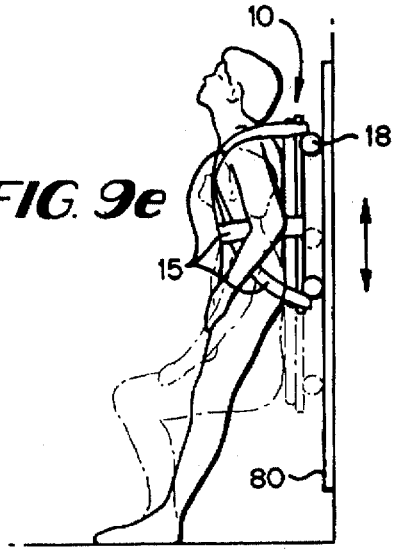

FIG. 11
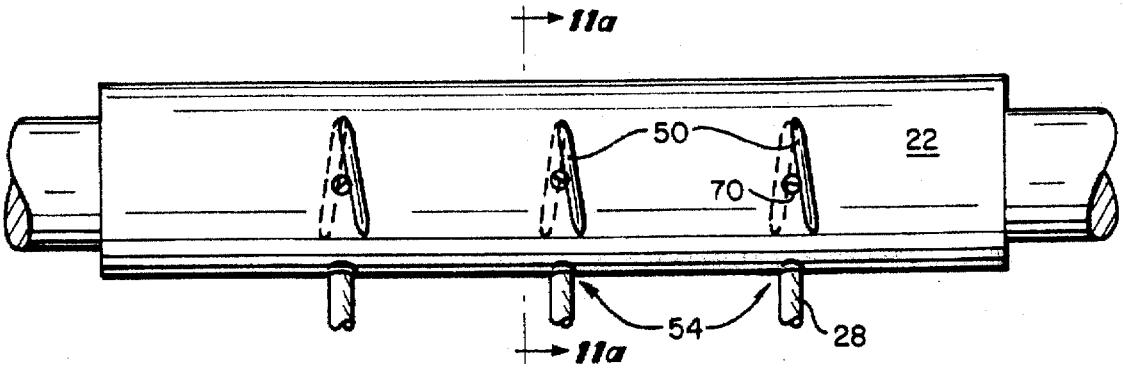
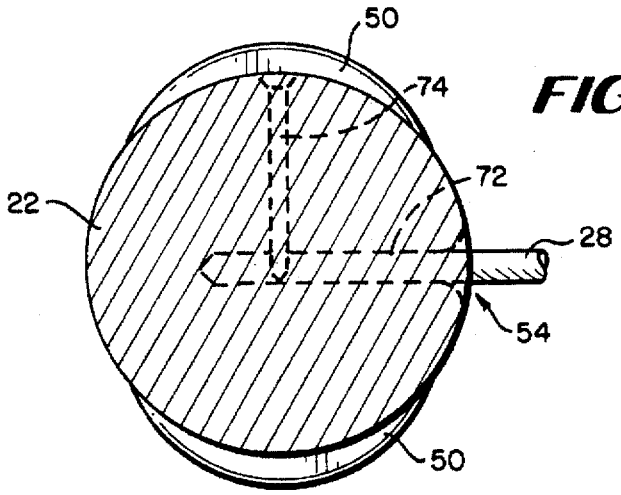
FIG. 11a
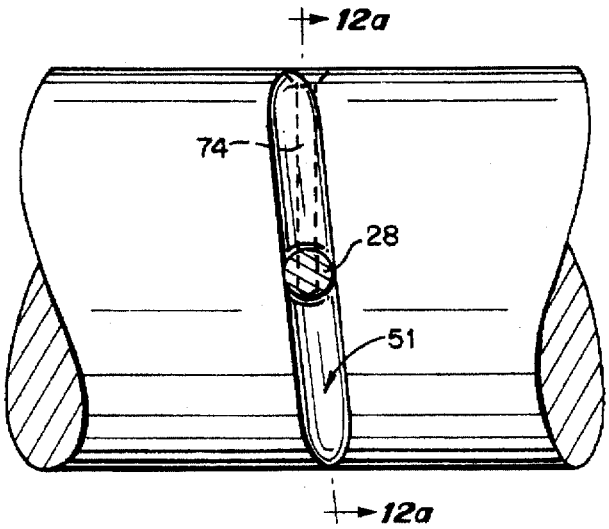
FIG. 12

ROLLING EXERCISE BENCH

CROSS REFERENCE TO RELATED APPLICATIONS

This is a continuation-in-part application of application Ser. No. 08/515,016, filed Aug. 14, 1995 now abandoned.

BACKGROUND AND SUMMARY OF THE INVENTION

The present invention relates to exercise devices and, more particularly, to a device for strengthening, conditioning, and/or rehabilitating various parts of the body, including the legs.

The strength-building exercise devices most commonly used today, free weights and stationary machines, suffer from many disadvantages. Free weights, while conducive to a broad range of exercises, can be expensive, unsafe and cumbersome to use. Stationary machines, whether plate-loaded or provided with a weight stack, typically only focus on one muscle or muscle group, require a great amount of space, and are often complicated and awkward to use. Due to expense and size, these devices are not readily adaptable to home use. Additionally, these devices are not capable of providing lifting assistance to users such as rehabilitation patients who are just regaining strength. There is thus a need for an exercise device for the legs and other parts of the body which is safe, inexpensive, portable, easy to use, and which offers variable resistance, including counter resistance.

Prior art devices related to leg exercising devices include, for example, the following U.S. Pat. Nos.: 1,996,350 to Schaff; 2,733,922 to Diego; 3,622,154 to Williams; 3,674,261 to Krug; 4,293,127 to Dudley; 4,659,077 to Stropkay; 4,700,945 to Rader; 4,706,953 to Graham; 4,884,802 to Graham; 4,930,769 to Nenoff; 5,169,363 to Campanaro et al.; 5,263,913 to Boren; 5,336,152 to Winslow et al.; and 5,383,831 to Drath.

It is thus one object of the present invention to provide an exercise unit that can effectively strengthen and develop the muscles of the body using readily available surfaces such as a wall, door, pad, or floor.

It is another object of the present invention to provide a cheaper and safer alternative to typical exercise machines and free weights.

It is yet another object of the present invention to provide an exercise device which can provide resistance or give counter resistance/assistance to the user during exercise.

It is a further object of the present invention to provide an exercise device for users who are rehabilitating an injury and need continued strengthening.

It is still a further object of the present invention to provide an exercise device for the legs which produces less strain on the lower back than free weights and other exercise machines.

It is another object of the present invention to provide an exercise device which is compact and light enough to be stored in a carry bag.

By the present invention, there is provided a portable, versatile exercising device which is simple and safe to use. The device may be strapped to the user's back and is provided with rollers for contact with a wall, door, pad, or floor. The rollers operate on a tension system which can increase resistance or provide assistance to the user while exercising. The device can be used for rehabilitation or for building strength and conditioning.

BRIEF DESCRIPTION OF THE DRAWINGS

FIG. 4 is an elevational view of the straight cylindrical embodiment of the spiralled cam of the present invention.

FIG. 5 is a side view of the cam of FIG. 4 partially cut away to show the loop and screw plug method of cord attachment.

FIG. 6 is an exploded perspective view showing the method used in FIG. 5 for attaching the cord to the cam.

FIG. 7 is an elevational view of the tapered cylindrical embodiment of the cam of the present invention.

FIG. 7*a* is an enlarged detail view of the circled portion 7*a* of FIG. 7, showing the curvature of the grooves.

FIG. 7*b* is an enlarged detail view of the circled portion 7*b* of FIG. 7, showing the curvature of the grooves.

FIG. 8 is a perspective view of the release mechanism for the central axle of the present invention.

FIGS. 9*a* through 9*h* are schematic views showing several exercises employing the device of the present invention.

FIG. 11 is a front elevational view of one embodiment of an axle of the present invention showing a directional lip positioned near each cord connection point.

FIG. 11*a* is a side cross-sectional view taken along line 11*a*—11*a* of FIG. 11 showing the openings provided for securing the cord within the axle.

FIG. 12 is a front elevation of one axle of the device of FIG. 10 showing a tracking groove around the cord connection point.

DETAILED DESCRIPTION OF THE PREFERRED EMBODIMENTS

Figure 1:
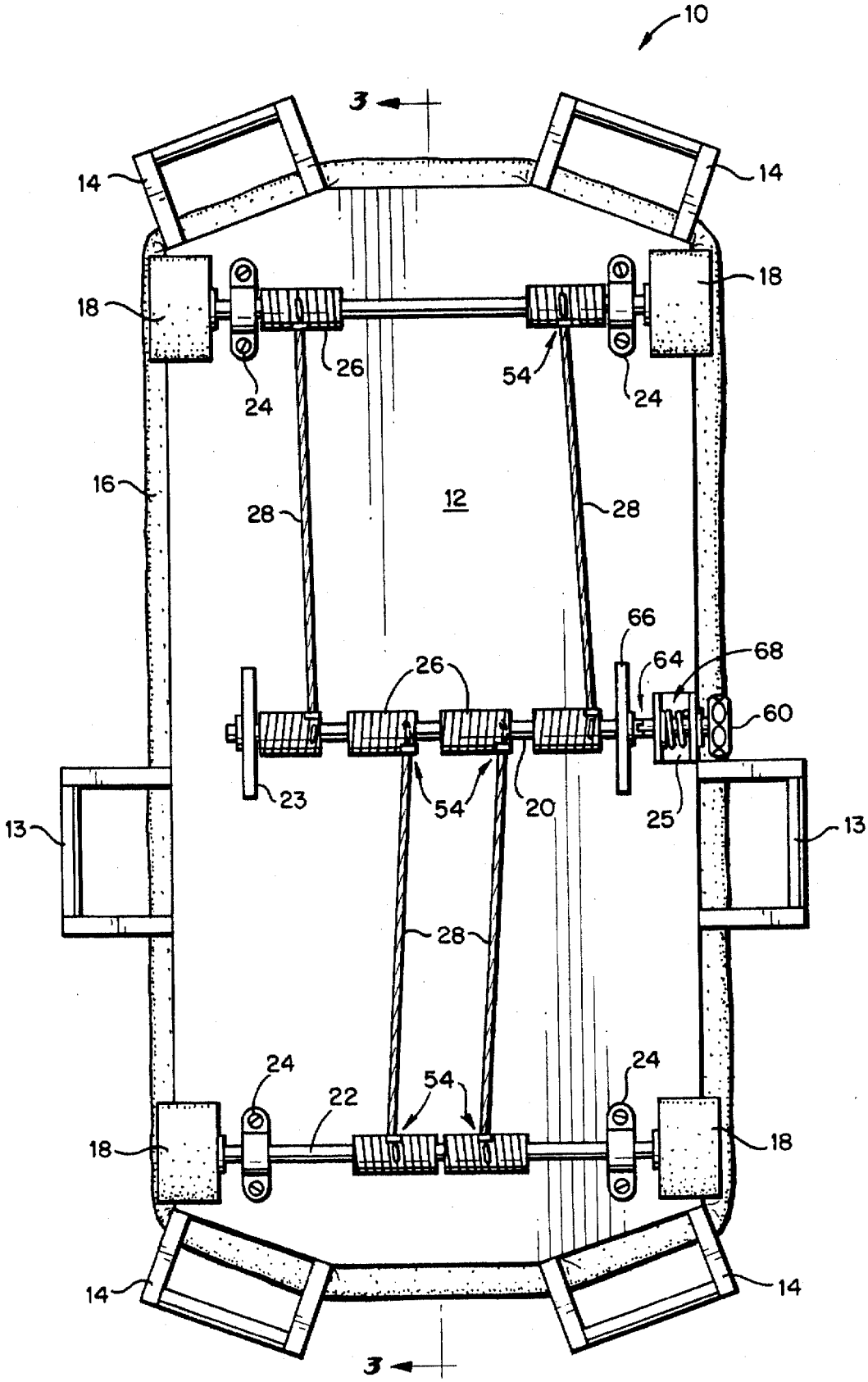
FIG. 1 is a rear elevational view of one embodiment of the device of the present invention showing the cam and cord arrangement.

As shown in FIGS. 1 through 16, there is provided a lightweight exercising device 10 having a back plate 12 and waist 13 and corner 14 brackets. Detachable straps 15 provided with VELCRO, for example, may be secured to the brackets 14 to secure the device 10 to the user's body as needed. Each corner bracket 14 is aligned with its respective diagonally opposed bracket to promote better strap functioning. The back plate 12 may be provided with padding 16 on the front side as well as an adjustable, detachable lumbar support for comfort and stress relief for the lower back during leg exercises. The padding 16 may be attached by VELCRO or the like so as to be easily detached in order to lighten the device and provide for the user a firmer non-skid surface when needed, such as when placing the feet directly on the back plate 12. Additionally, an adjustable and detachable shoulder pad or harness may be secured to the back pad 16 as a replacement for the straps 15 and brackets 13, 14 to give the user added comfort and a better fit and to decrease slipping of the device on the back. The pad or harness also allows quicker attachment of the device to the user.

Figure 10:
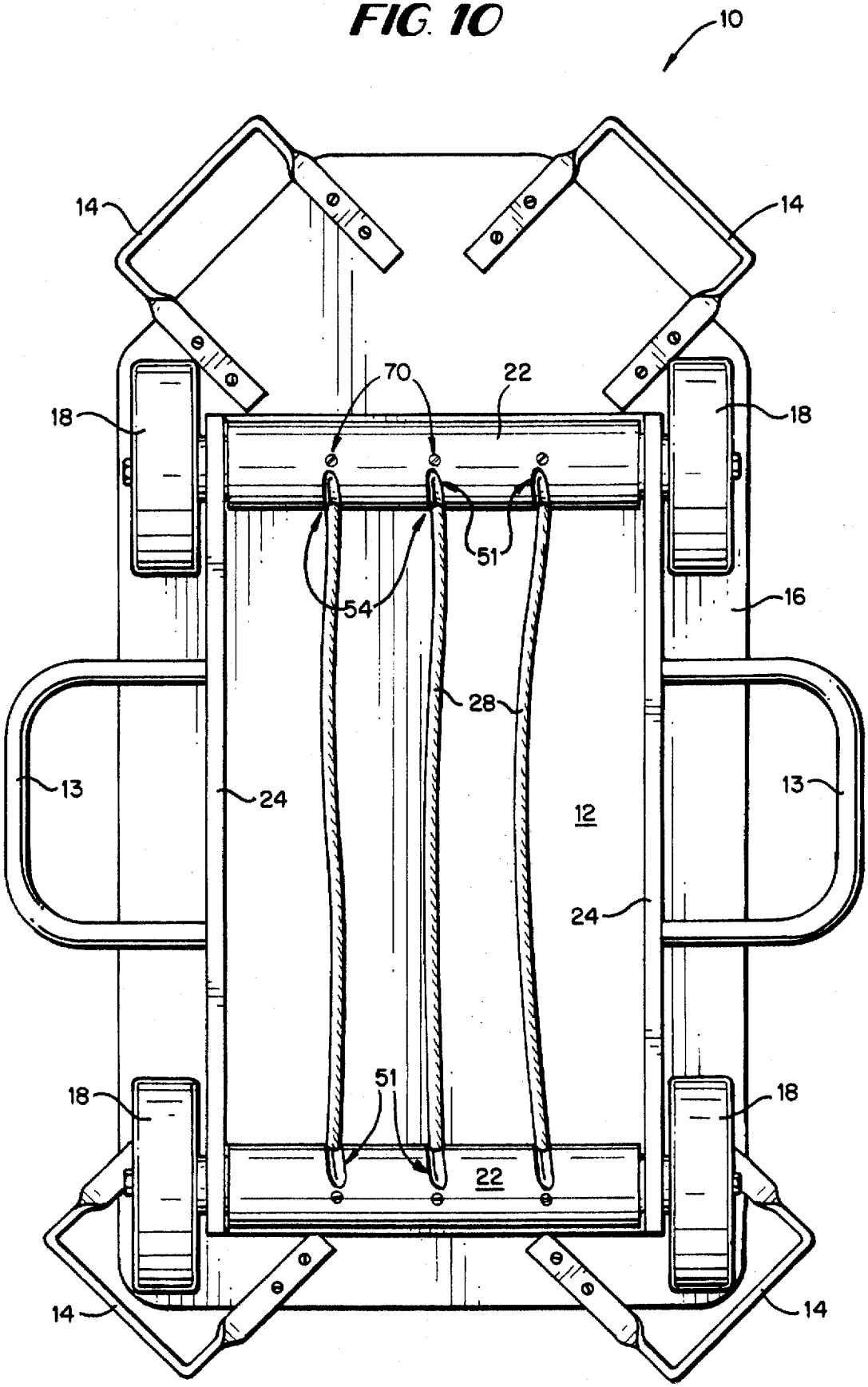
FIG. 10 is a rear elevational view of one embodiment of the device of the present invention showing cords connected directly to the roller axles.
Figure 13:
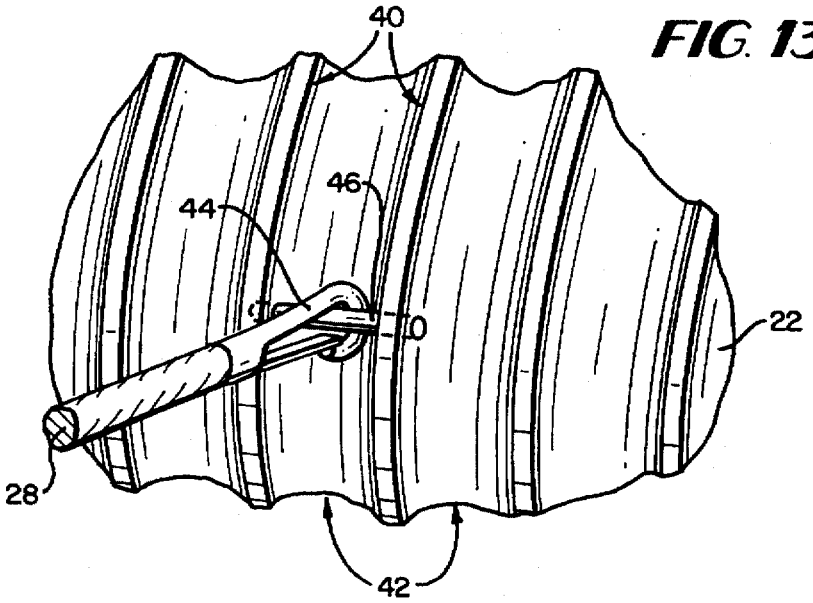
FIG. 13 is a partial elevation of one embodiment of an axle of the invention showing the rod and clip method of cord attachment.

In the embodiment of the invention as shown in FIG. 10, the rear side of the back plate 12 is provided with two parallel rotatable axles 22. The axles may be generally smooth as shown in FIG. 10 or may be provided with a spiralled exterior 40 as shown in FIG. 13. Brackets 24 are secured to the back plate 12 to support rotation of the axles 22 using ball bearings or the like. Rollers or wheels 18 are mounted to the ends of the axles 22 outside of the brackets 24 so as to rotate in conjunction with the axles 22.

To help provide variable resistance for the device, elastic connectors such as cords 28 are connected to the axles 22 such that, when the wheels 18 are rolled, the axles 22 rotate and the cords 28 wind or unwind around the axles. The further the wheels are rolled in one direction, the tighter the cords will become and therefore the greater the resistance will be for the device to continue to travel in the same direction. As the wheels are rolled back towards their starting position, the cord tension is lessened. Thus, for the typical exercise, the user of the device will experience progressively increasing resistance to the initial direction of travel until reaching the desired limit to the range of motion. Upon returning the device to its starting position, the user will experience assisted resistance as the cords unwind from the axles. The user may optionally pre-load tension into the device by rotating one or both axles, such as by rotating the wheels, so that the cords are initially wound and the user can thereby start the exercise at a higher level of resistance.

The device 10 may employ one cord or a plurality of cords as cords of different resistances and thicknesses may be easily interchanged. The type of cords employed depend upon the range of resistance desired by the user for a given exercise. For example, the user may employ bungee-type cords with a limited degree of elasticity or rubber-type cords such as tubing with a substantial degree of elasticity. Bungee cords are useful for those exercises in which the user desires a definite stopping point for the device, such as occurs when the cord reaches its stretched limit. Rubber-type cords are beneficial when the user desires a greater range of motion before the stopping point is reached or when the user does not desire to reach the stretched cord limit. Other types of elastic cord connectors may be employed and include, for example, hollow latex I.V. tubing, rubber straps such as tarpaulin straps having limited elasticity, and THERA-BAND TUBING, which is commercially available from Hygenic Corp., Akron, Ohio, 44310. Thus, the range of resistances available to the user is potentially unlimited as both the number and type of cord may be easily varied.

As shown in FIGS. 10 through 12*a*, the cords 28 may be connected to the axles 22 using set screws 70. For this type of connection, each cord end 29 is positioned inside a bore hole 72 at its respective cord connection point 54 in the axle. A set screw 70 is then inserted into an opening 74 bored at an angle to the cord connection hole 72 on the axle. This angle may be 90 degrees, for example. The screw opening 74 mates with the cord connection bore hole 72 at a position within the core of the axle 22. This allows the inserted screw 70 to pinch and maintain the cord end 29 within the bore hole 72 during use of the device. The screw may also pierce the cord end 29. In one embodiment of the invention, the screw opening 74 extends beyond the bore hole 72 to allow the screw 70 to extend fully through the cord end 29 and the bore hole 72. The use of the set screw promotes simple interchangeability of the cords.

Figure 12A:
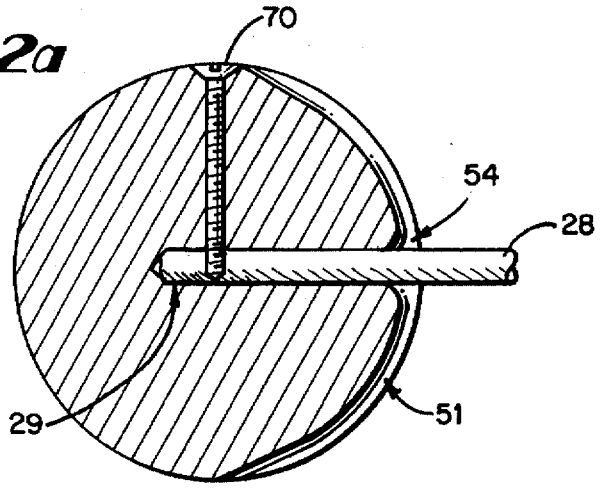
FIG. 12*a* is a side cross-sectional view taken along line 12*a*—12*a* of FIG. 12 showing the screw piercing method of cord attachment.

The cord 28 may alternatively be connected to the axle as shown in FIG. 13 by a clip 44 secured to each end of the cord 28 which hooks around a rod 46 secured to the axle. The rod 46 may be secured between two spirals 40 in the axles 22 when the axles are provided with a spiraled exterior as shown in FIG. 13. In the embodiment of the axles without spiral grooves, as shown in FIG. 12, the rod can be secured into the axle 22 above the groove 51, for example. The clip 44 allows quick and simple changing of the cords 28 and provides a cord attachment subject to less wear than the cord end 29 of FIG. 12*a*.

Figure 14:
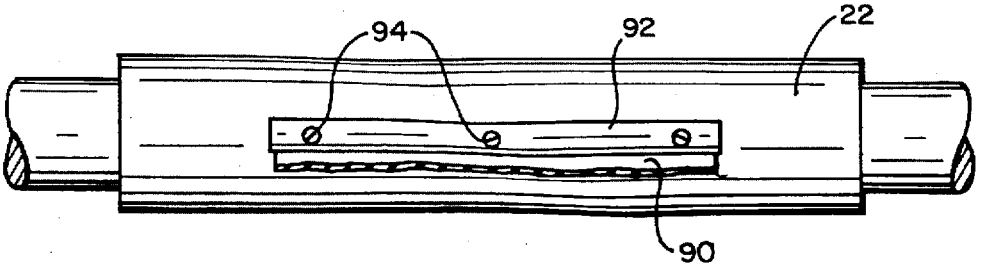
FIG. 14 front elevation of one embodiment of an axle of the present invention for use with the tensioning band.
Figure 15:
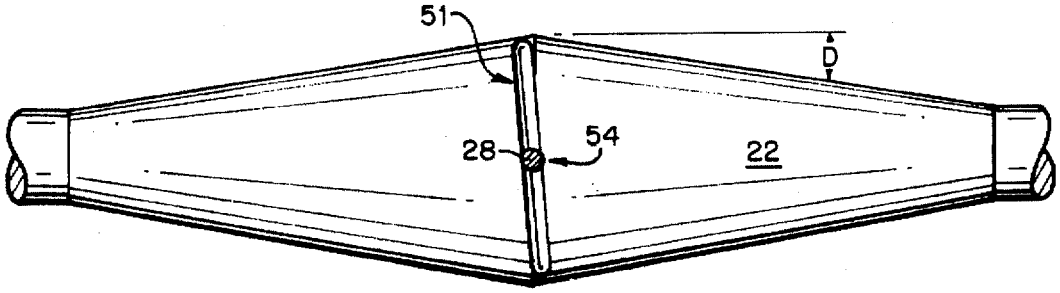
FIGS. 15 and 16 are front elevational views of the tapered axle embodiments of the present invention.
Figure 16:
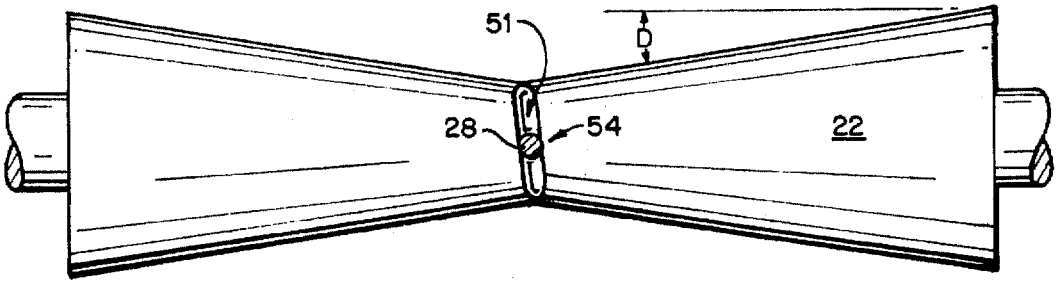

The axles may be cylindrical in shape as shown in FIGS. 10, 11, and 14. In one embodiment of the invention as shown in FIGS. 15 and 16, the axles 22 have a tapered cylindrical shape tapering either downwardly (FIG. 15) or upwardly (FIG. 16) away from the cord connection points 54. The tapering angle D of the axle may be, for example, between about 5 and about 30 degrees. In a preferred embodiment, this angle D is 10 degrees. The tapered axles provide a further simple way to change the available range of resistances for the user. For example, the user employing downwardly tapered axles as shown in FIG. 15 will encounter increased resistance at a slower rate than would occur if employing straight cylindrical axles. Conversely, the user employing upwardly tapered axles as shown in FIG. 16 will encounter increased resistance at a faster rate than with straight cylindrical axles. In one embodiment of the invention, the axles differ in shape such that one axle is cylindrical and the other axle tapered or such that each axle is tapered to a different degree. This embodiment promotes smooth cord tracking on the axle having a lower tapering angle and allows the user to bias the resistance towards one end of the device, if desired.

Figure 14A:
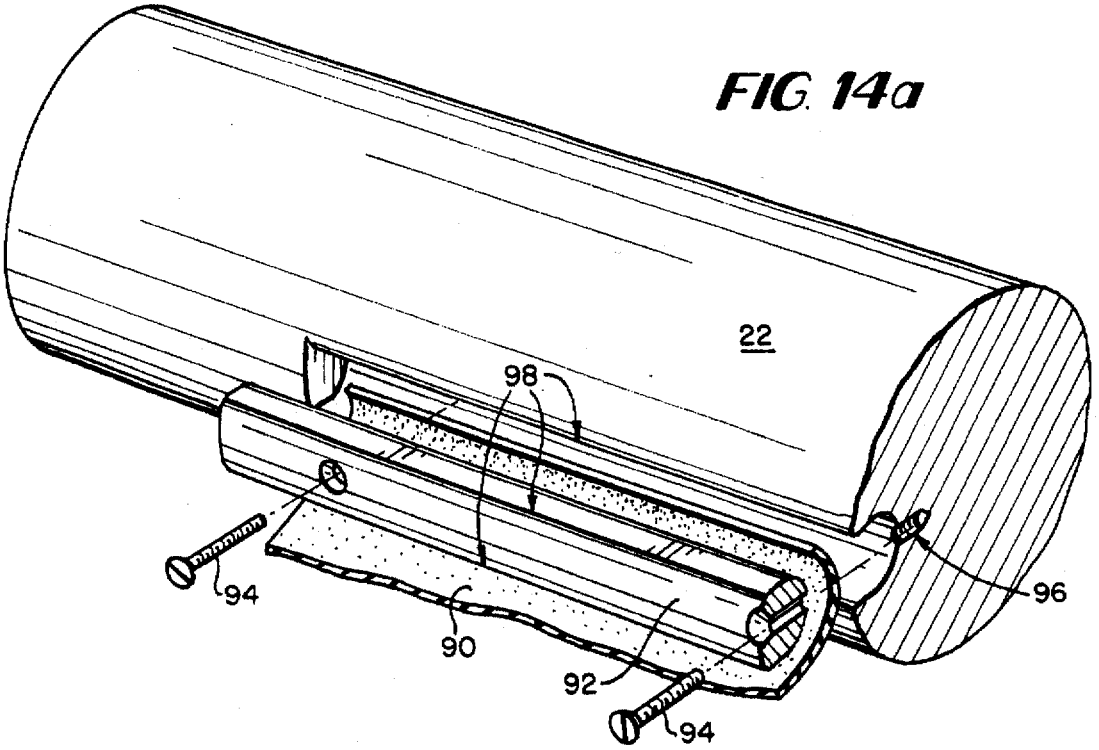
FIG. 14*a* is an exploded perspective view of the axle of FIG. 14 cutaway to show the method of attaching the band to the axle.

As shown in FIGS. 14 and 14*a*, instead of using cords, the axles may alternatively be connected using a flat band 90 of elastic material such as THERA-BAND, commercially available from Hygenic Corp., Akron, Ohio, 44310. The band 90 may be attached to the axles 22 by removing an elongated screw plug 92, inserting the band 90, and then tightening set screws 94 through openings provided in the screw plug 92 which mate with threaded openings 96 in the axles. The flat band 90 is thus easily interchangeable with bands of varying elasticity to offer a broad range of available resistances. In this embodiment, when the wheels 18 are rotated in one direction, the band 90 will wrap around the axles, overlapping itself and increasing tension as it is wound tighter. The band therefore requires no tracking mechanism on the axles. Additionally, the screw plug 92 and the axle 22 will have rounded edges 98 to prevent undesired crimping of the band 90 as it wraps.

The wheels 18 are mounted to the axles 22 so as to be easily interchanged with wheels of different size or construction. This allows the user to control the rate at which the cord or band reaches its tension limit. For example, the wheels 18 may be three inches, four inches, or five inches in diameter depending on the user's desired range of travel. Replacing the three inch diameter wheels with the four inch diameter wheels, for example, affords the user approximately six more inches of travel distance with the device for a given cord or band elasticity. That is, for a given cord or band, four inch wheels will allow the device to travel approximately six inches further than three inch wheels before the tension limit of the cords or band is reached. Similarly, replacing the four inch diameter wheels with five inch diameter wheels allows the user approximately ten more inches of travel distance for a given cord. The wheels 18 may be of solid construction such as a typical cart wheel, of softer construction such as a softer rubber material, or the wheels 18 may alternatively be filled with air or gel.

In one embodiment of the invention, each wheel is mounted to a roll pin secured through the axle at a location outside of the ball bearing mounts. Washers and a screw then secure each wheel in place. This prevents slippage of the wheel on the axle. In another embodiment of the invention, each wheel is mounted using a cotter or hitch pin extending through the axle.

In order to promote proper tracking when using cords to provide resistance, each axle may be provided with a tracking groove or indentation 51 at the cord connection points as shown in FIGS. 10, 12, 12*a*, 15, and 16. The tracking grooves 51 influence the cords to track in a particular direction upon rotation of the axles 22 and also help to prevent kinking of the cord 28 as it begins to wrap. As the axles continue to rotate in the initial direction, each cord will track alongside itself about the axles. In one embodiment of the invention, the tracking groove 51 is at an angle of between 5 and 20 degrees and extends roughly halfway around the axle 22. Alternatively, a starter or directional lip 50 may be provided at or near the cord connection point 54 as shown in FIGS. 11 and 11*a*. The lip 50 also directs the cord 28 in the proper direction about the axles 22. The lip 50 may include an inclined ramp to reduce wear on the cord. In one embodiment of the invention, each lip 50 or tracking groove 51 of one axle is angled in the same direction as its corresponding lip or groove on the other axle so that, when the axles are rotated, the cords will track so as to maintain vertical alignment.

As mentioned earlier and also as shown in FIG. 13, each axle may also be provided with a spiraled exterior 40 much like a typical screw to promote proper cord tracking. The spiraled exterior 40 induces smooth movement of the device during operation due to uniform tracking of the cords in the grooves 42 located between the spirals 40. This also prevents premature wear caused by cords wrapping or tracking upon themselves when the axles are rotated. As shown in FIG. 4, in the embodiment of the invention with cams, the spirals 40 are preferably of minimal angle A to the normal axis of the axles such as between about 0 and about 15 degrees so as to allow the cord 28 to track multiple times about the axle without greatly increasing its distance from the cord connection point 54. In one embodiment of the invention, this angle A is 5 degrees. In a further embodiment of the invention, the spirals of one axle are angled in the same direction as the spirals of the other axle. This maintains the cord in substantially perpendicular relation to the axles during operation of the device which helps prevent cord slippage.

In the embodiment of the invention as shown in FIG. 1, the rear side of the back plate 12 may be provided with three parallel rotatable axles—a central axle 20 and two dependent axles 22. Brackets 23, 25 support rotation of the central axle 20 and brackets 24 support rotation of the dependent axles 22 using ball bearings or the like. The brackets 23, 24, 25 are secured to the back plate 12 by screws, welding, or the like. Rollers or wheels 18 are mounted to the ends of the dependent axles 22 so as to rotate in conjunction with the dependent axles 22.

To help provide variable resistance for the device, a network of cams 26 may be individually secured on the axles 20, 22 by lips or the like on each axle. Cams may also be employed in a similar manner to that being described in the embodiment of the invention without a central axle. Each cam 26 on the central axle 20 is connected by a cord 28 to a corresponding cam 26 on one of the dependent axles 22. As shown in FIG. 6, cord connection to the cams 26 may be established by plugging the cords 28 into the cams 26 at the cord connection point 54 using a screw plug 30 having a male end 32 which fits into a loop or female end 34 of the cord 28. A screw 36 secures the screw plug 30 into each cam 26. The cords may also be connected to the cams in manners similar to those described earlier for the attachment of the cords directly to the axles. Additionally, the cams may be connected by flexible bands in a manner similar to that described earlier in the embodiment of the invention without a central axle. Alternatively, the axles 20, 22 may be connected by cords or bands without the use of cams.

As shown in FIG. 1, the cord connection point 54 for the central axle cams is at the right axially outer edge of the cam and for the dependent axle cams is at the center of the cam. Since the central axle cams will only track to the left of the cord, connecting the cords at the right edge of the central cams promotes efficient use of the available cam surface area. The cams 26 may also be provided with a directional lip 50 as shown in FIG. 4 or with indentations 27 around the cord connection point 54 as shown in FIGS. 5 and 6 to promote better tracking and prevent undesired kinking of the connected cord 28 as it begins to wrap.

The central axle 20 is preferably equidistant from each dependent axle 22. In one embodiment of the invention, the central axle 20 has four cams 26 and each dependent axle 22 has two cams 26 such that the two innermost cams of the central axle 20 are connected to the two cams of one dependent axle 22 and the two outermost cams of the central axle 20 are connected to the two cams of the other dependent axle 22, as shown in FIG. 1. Each pair of connected cams 26 is preferably vertically aligned as shown in FIG. 1 so as to prevent slippage of the cords 28 during operation. In one embodiment of the invention, the central axle is provided with one or more races extending axially along the outer surface of the central axle. Ball bearings would then allow the cams on the central axle to glide horizontally along the central axle with the movement of the cords so as to maintain vertical alignment of the cords during use.

As shown in FIG. 4, each cam may be provided with a spiraled exterior 40 to promote cord tracking. Additionally, as shown in FIGS. 7, 7*a*, and 7*b*, the grooves 52 on each spiraled cam may be concave so as to face the cord connection point 54 of the cam 26 and thereby assist the cords in tracking appropriately along the cam surface. The concave grooves 52 are at minimal angle C to the normal axis of the cams, such as between about 0 and about 15 degrees.

In a further embodiment, the cams may be tapered upwardly or downwardly from the cord connection point. The cams are tapered downwardly in FIG. 7 at a taper angle B which may be, for example, between about 5 and about 30 degrees. In a preferred embodiment, this angle B is 10 degrees. When provided on the dependent axles 22, the downwardly tapered cylindrical cams 26 allow a more gradual cord tracking during rotation of the wheels. This results in less fluctuation in tension during operation. Upwardly tapered cams provide for quicker cord tracking and thus a quicker change in tension.

Figure 2:
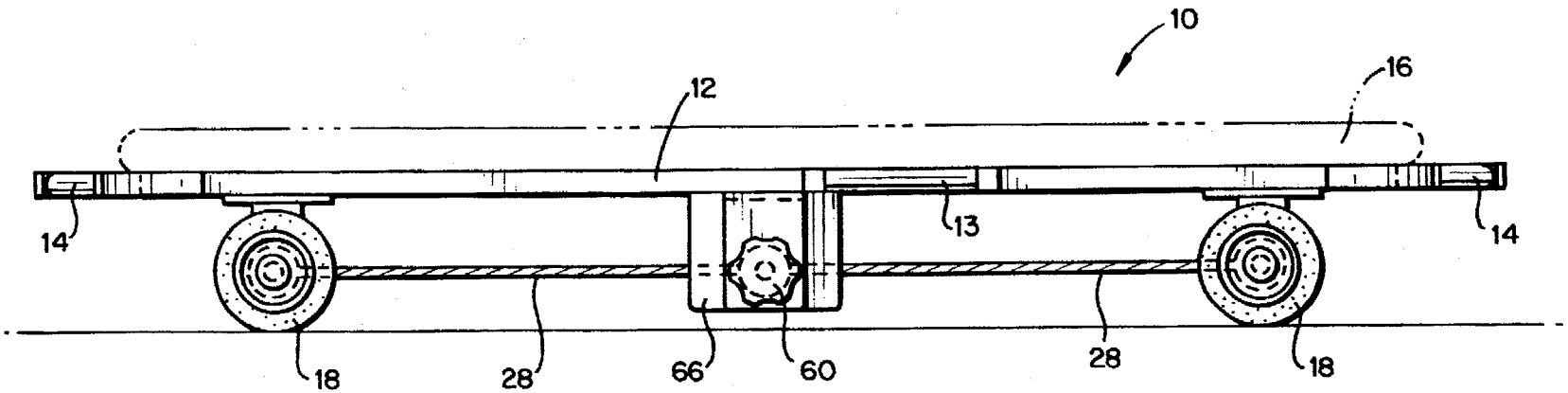
FIG. 2 is a left side view of the device of FIG. 1 showing the cords in the initial relaxed setting.
Figure 3:
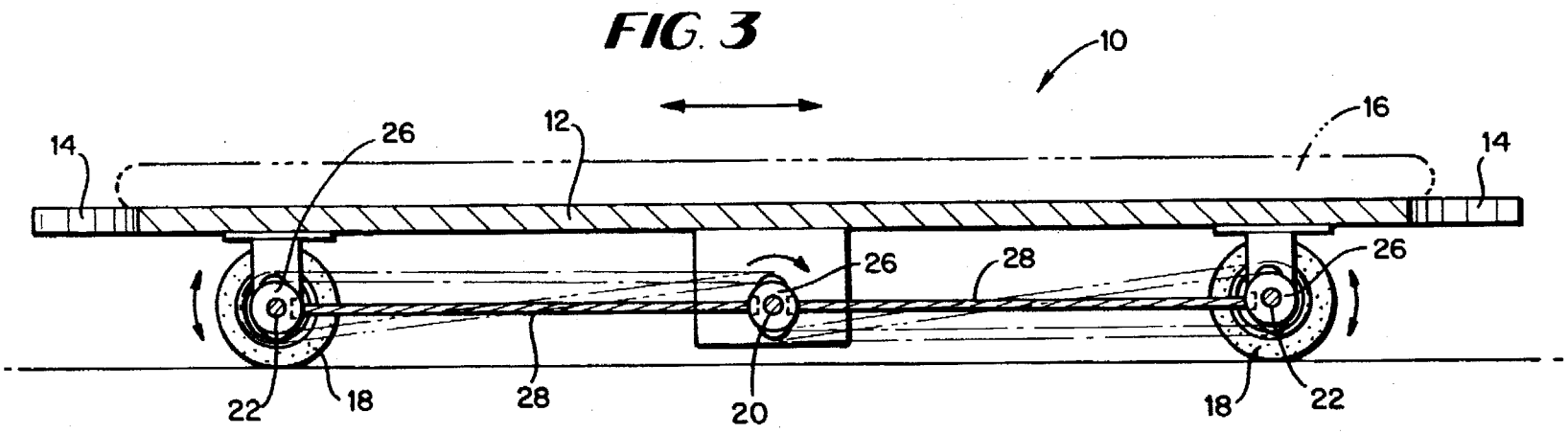
FIG. 3 is a left side cross-sectional view taken along line 3—3 of FIG. 1 showing axle rotation and cord movement associated with a pre-set tension in the cords.

As shown in FIGS. 1 through 3, a tension control knob 60 mounted to the central control axle 20 allows for adjustment of the cord tension which thereby affects the resistance to rotation of the dependent axles 22. The tension control knob 60 rotates the central axle 20 thereby rotating the central axle cams 26 and winding the cords 28 around the central axle cams 26. The further the tension knob 60 is turned, the tighter the cords become, and thus the greater is the degree of resistance to rotation of the dependent axles 22.

In one embodiment of the invention, the tension control knob 60 is a one-way crank similar to a ratchet with a pull-release mechanism 64 capable of resetting the tension. The knob 60 is capable of holding the tension created by each incremental turn such that the central axle 20 will not rotate with the dependent axles 22 when the wheels 18 are subsequently rotated. When it is desired to release the set tension, the knob 60 is pulled, allowing the pull release mechanism 64 to temporarily separate central axle portions 20, 20*a*, as shown in FIG. 8. This allows the portion of the central axle 20 connected to the cams to rotate back to its initial setting so that the cords are not wound around the central axle cams.

The tension knob 60 is spring loaded as at 68 to promote re-engagement of the central axle 20 after the tension is released. Additionally, a tension support rod or bracket 66 with ball bearings may be mounted to the back plate 12 to maintain the central axle 20 in position once the pull-release mechanism 64 is separated. This support rod 66 does not allow the central axle 20 to retract when the tension control knob 60 is pulled such that quick resetting of the tension in the cams 26 is possible.

FIGS. 1 and 2 show the cam and cord configuration before any tension is applied. None of the cords 28 have begun to track around the cams 26. As the tension knob 60 is rotated clockwise, for example, each cord 28 will track around its respective central axle cam 26. In one embodiment of the invention, the grooves 42 on each central axle cam 26 are oriented counter-clockwise.

Once the initial tension level is set by rotating the central axle 20, rotation of the wheels will initially increase the tension further as the cords begin to track on the dependent axle cams, as shown in FIG. 3. For example, if the wheels 18 are rotated in a counter-clockwise direction, the dependent axle cams 26 will track their respective cords 28 in one direction on the cam, thereby increasing the cord tension throughout the counter-clockwise wheel rotation. When the wheels are subsequently rotated back in a clockwise direction, such as after the user has reached a limit on his or her range of motion, the cords will untrack or unwind on the dependent axle cams, thereby decreasing the tension. In one embodiment of the invention, as shown in FIG. 1, the grooves in the dependent axle cams 26 spiral in the direction opposite the central axle cam grooves, such that, when the wheels 18 are rotated in the anticipated direction, the cords 28 will track on the dependent axle cams 26 in the direction which seeks to vertically align each cord between its two cams.

As shown in FIGS. 9*a* through 9*h*, the present device 10 may be used to exercise or rehabilitate several parts of the body. A pad 80 capable of use on a wall, door, or floor may be provided with grooves which align with the wheels 18 so as to guide the device 10 and prevent skidding during use. The pad would be secured to the desired surface by a gripping element such as suction cups, Velcro, straps or the like so as not to slide with the device. Additionally, the front side of the back plate 12 may be built up using separate attachments along with the back pad 16 to provide greater comfort and adaptability for particular exercises. An optional latching door may be provided as a safety feature to cover the interior moving parts on the back face of the back plate 12.

When used in performing a wall squat, for example, as shown in FIG. 9*e*, the user secures the device 10 to his or her back using the straps 15. The device 10 is of sufficient size to provide contact with the majority of the user's back and thereby support the spine. The shoulder straps in particular help to promote good posture. An optional lumbar support may also be strapped to the device for back support. Additionally, an optional detachable and adjustable shoulder harness or shoulder pad may be secured to the back pad 16 to provide the user with added comfort and better fit and prevent slippage of the device on the back. As the user rests the device against the wall surface, only the wheels 18 come into contact with the wall or previously secured pad 80. In one embodiment of the invention, the wheels 18 are 2 to 2½ inches in width to achieve greater contact with the wall or wall pad and help prevent slipping. Upon moving up and down the wall, the user feels any pre-loaded tension either resisting or assisting leg motion. By varying the positioning of the feet, such as by widening the stance or placing the feet further forward, the user can place emphasis on different muscles in the gluteal and thigh areas. For example, forward foot placement can emphasize working of the upper hamstring and gluteal muscles.

If the user starts the wall squat exercise in the descended position, shown in phantom in FIG. 9*e*, the device will increase the resistance to the user as the user ascends and decrease the resistance as the user descends to the starting position. Similarly, if the user starts the wall squat exercise in the standing position, shown in solid lines in FIG. 9*e*, the device will increase resistance as the user descends and decrease the resistance as the user ascends back to the standing position. Thus, assisted resistance is available if the user begins the exercise in the standing position. Assisted or counter resistance allows the user to lift less than full body weight and is desirable particularly for those users just beginning to exercise after injury.

As shown in FIG. 9*a*, the device may be used as a shoulder exerciser against a wall, for example. The device may be gripped according to whether horizontal abduction/adduction or vertical flexion/extension motion is desired. An additional shoulder exercise may be performed wherein the user lies prone on the device and uses his or her hands to move across the floor like a crab.

As shown in FIG. 9*b*, the device may also be used to exercise the calves. The user may employ a foot support 77 to promote proper form when raising the heel. Another lower leg exercise may be performed by raising the toes to exercise the anterior tibialis. Such an exercise requires no foot support and may employ the assisted resistance mechanics of the device.

Figure 9F:
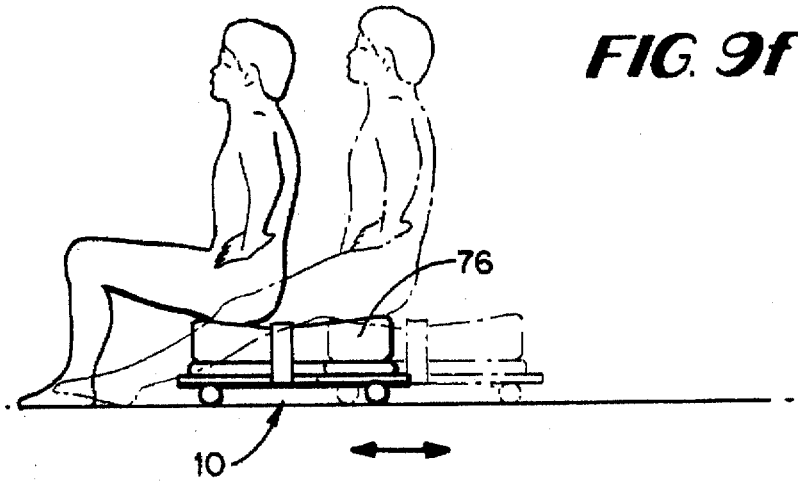
Figure 9G:
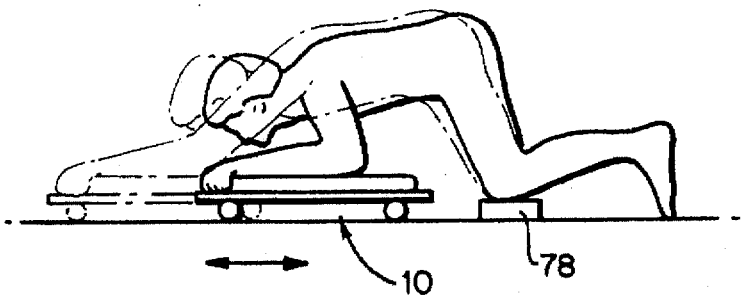
Figure 9H:
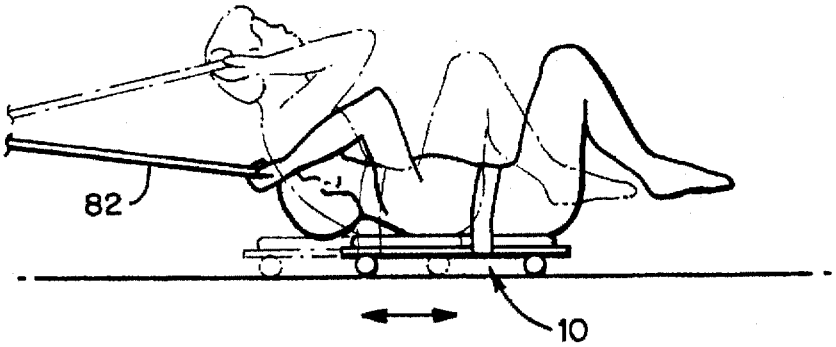

Other leg exercises of particular benefit to the knees are shown in FIGS. 9*c*, 9*d*, and 9*f*. For example, the ski simulation shown in FIG. 9*c* may be simulated to employ the sling shot effect provided by the device 10. This exercise can be used to increase proprioception, endurance, and strength. The user stands on the device while maintaining a grip on a fixed object 70 for balance. The skiing effect may then be obtained by the user pulling himself from side to side. For more advanced users, the ski simulation may be performed without holding a fixed object by properly shifting weight. Further, the device may be used for plyometric exercises where the user lies supine on the device and springs or bounces away from a wall or vertical surface to improve explosive power, strength, and jumping ability. In the same position, the traditional leg press can be performed.

FIG. 9*d* shows the user lying on a table with his feet strapped to the device 10 as the device is held against a wall pad 80. This "wall slide" exercise helps the user in need of increased knee flexion as the resistance can be used to assist the legs into flexion. Resistance may be reversed on the device in this exercise for the user who desires hamstring strengthening. A similar exercise may also be performed in a seated position with the device against the floor, as shown in FIG. *9f*. For this exercise, the user may sit on a built up pad 76 strapped onto the device and begin scooting or walking against the resistance either forward and back or in a side to side motion.

As shown in FIGS. *9g* and *9h*, the device may also be used to exercise the abdominal muscles. In FIG. *9g*, a preacher crunch is performed by placing the device on the floor and placing the weight of the upper body on the device. The knees should rest on the floor on a knee pad 78 for comfort. By moving up and back, the user can exercise the abdominal area at variable resistances. As shown in FIG. *9h*, to perform a crunch in the traditional position, the user lies on his or her back on the device and pulls against a rope or Y-strap 82 which is secured away from the user to a door, table or the like.

In one embodiment, the device may be of a reduced size so as to permit manipulation by the user's hand, arm, or leg in occupational therapy type exercises. In this embodiment, the axles on the device may be positioned so as to run parallel to the vertical axis of the device.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An exercise device, comprising:

a bench having front and back faces;

a pair of parallel axles rotatably mounted on said back face;

rolling means secured to said axles for allowing rolling movement of said bench; and tensioning means secured to at least one of said axles for increasing resistance to the rolling movement of said bench in a first direction and providing assistance or decreasing resistance to the rolling movement of said bench in a second direction reciprocal to said first direction.

2. The device of claim 1 wherein said tensioning means includes at least one flexible tension member having two ends, each end being secured to a respective axle at a respective connection point thereon such that when said rolling means are rotated, said at least one tension member wraps or unwraps around said axles, thereby changing the resistance to rotation of said axles.

3. The device of claim 2 wherein said at least one flexible tension member is an elastic cord.

4. The device of claim 3 wherein said elastic cord is a bungee cord.

5. The device of claim 3 wherein said elastic cord is a rubber cord.

6. The device of claim 3 wherein said axles are of a tapered cylindrical shape such that the diameter of each of said. axles is greatest at each connection point thereon.

7. The device of claim 3 wherein said axles are of a tapered cylindrical shape such that the diameter of each of said axles is smallest at each connection point thereon.

8. The device of claim 3 further including tracking means for guiding said at least one cord about said axles.

9. The device of claim 8 wherein said tracking means includes a directional lip secured to each of said axles near said connection points.

10. The device of claim 8 wherein said tracking means includes spiral grooves on each of said parallel axles.

11. The device of claim 10 wherein said grooves extend around said axles at an angle to the normal axis of said axles, said angle being between about zero and about fifteen degrees.

12. The device of claim 11 wherein said angle is five degrees.

13. The device of claim 8 wherein said tracking means includes an indentation within each of said axles at said connection points.

14. The device of claim 2 wherein said at least one flexible tension member is a flat band of resilient material.

15. The device of claim 1 wherein said rolling means comprises wheels mounted at the ends of said axles.

16. The device of claim 1 further including means for securing said bench to a user.

17. The device of claim 1 wherein said tensioning means is secured to said pair of axles.

18. The device of claim 17 wherein said tensioning means includes at least one flexible tension member having two ends and at least one pair of cams secured to said pair of axles such that for each cam pair, one of said cams is secured to a first one of said axles and the other of said cams is secured to a second one of said axles, wherein each end of said at least one flexible tension member is secured to a respective cam at a connection point.

19. The device of claim 18 wherein said cams are cylindrical in shape.

20. The device of claim 18 wherein said cams are of a tapered cylindrical shape such that the diameter of said cams is greatest at the connection point thereon.

21. The device of claim 18 wherein each of said cams are of a tapered cylindrical shape such that the diameter of said cams is smallest at the connection point thereon.

22. The device of claim 18 further including spiral grooves on said cams.

23. The device of claim 17 wherein said tensioning means includes a central axle rotatably mounted on said bench back face, said central axle being connected to said pair of axles by at least two tension members, wherein a first of said at least two tension members is secured between said central axle and a first of said pair of axles and wherein a second of said at least two tension members is secured between said central axle and a second of said pair of axles.

24. The device of claim 23 wherein said tensioning means further includes a tension handle mounted to said central axle capable of rotating said central axle so as to wind and unwind said at least two tension members about said central axle.

25. The device of claim 24 wherein said tension handle includes a one-way crank and said central axle includes a pull release mechanism such that turning said tension handle winds and holds said at least two tension members about said central axle for increased tension and pulling the handle allows said at least two tension members to unwind for decreased tension.

26. The device of claim 25 further including central axle displacement control means for preventing displacement of said central axle when said tension handle is pulled.

27. The device of claim 26 wherein said central axle displacement control means includes a tension bracket mounted to said back face and secured about said central axle so as to allow rotation of said central axle while preventing horizontal displacement of said central axle.

* * * * *